United States Patent [19]

Gagliardo

[11] Patent Number: 4,473,190

[45] Date of Patent: Sep. 25, 1984

[54] ADJUSTABLE NOZZLE FOR FIRE-EXTINGUISHING FLUIDS

[75] Inventor: John P. Gagliardo, Shrewsbury, Mass.

[73] Assignee: Feecon Corporation, Westboro, Mass.

[21] Appl. No.: 431,283

[22] Filed: Sep. 30, 1982

[51] Int. Cl.[3] ..... B05B 1/30; B05B 1/26

[52] U.S. Cl. ..... 239/456; 239/499; 239/583

[58] Field of Search ..... 239/456, 541, 505, 507, 239/514, 583, 499, 438, 443

[56] References Cited

U.S. PATENT DOCUMENTS 2,552,445 5/1951 Nielsen ..... 239/456

*Primary Examiner*—Jeffrey V. Nase
*Assistant Examiner*—James R. Moon, Jr.
*Attorney, Agent, or Firm*—Blodgett & Blodgett

[57] ABSTRACT

Nozzle for use with a non-aspirated fire-fighting medium capable of a selection of two rates of flow and two modes of spray control.

3 Claims, 3 Drawing Figures

HIGH FLOW

LOW FLOW

ADJUSTABLE NOZZLE FOR FIRE-EXTINGUISHING FLUIDS

BACKGROUND OF THE INVENTION

In the operation of fire-fighting equipment, it is desirable to have available a nozzle for use with a non-aspirating liquid that is capable of operating with a selected one of two considerably different flow rates, while at the same time allowing a selection between a spray and a solid stream of fluid. Because of the extreme flow rates and the forces that are used in fire-fighting, the normal methods of controlling these factors in applications (such as are used in a garden hose and the like) are not appropriate. In the past, nozzles that are capable of these necessary functions have been expensive to manufacture. Also, they have been quite complicated and, therefore, liable to become broken or out of adjustment. These and other difficulties experienced with the prior art device have been obviated in a novel manner by the present invention.

It is, therefore, an outstanding object of the invention to provide a nozzle capable of operating at two distinct flow rates and with two modes of spray quality.

Another object of this invention is the provision of a multiple function nozzle which is simple and rugged in construction.

A further object of the present invention is the provision of a nozzle which is inexpensive to manufacture and which is capable of a long life of useful service with a minimum of maintenance.

It is another object of the instant invention to provide a nozzle that gives a wide range of control of flow rate without introducing a large amount of resistance to flow.

With these and other objects in view, as will be apparent to those skilled in the art, the invention resides in the combination of parts set forth in the specification and covered by the claims appended hereto.

SUMMARY OF THE INVENTION

In general, the invention consists of a nozzle for non-aspirated fire-fighting medium, including a fixed assembly including a housing and a button, the assembly having a cylindrical surface, the housing and the button being concentric with the cylindrical surface. A first sleeve is mounted concentric with and slidable on the cylindrical surface and is movable relative to the housing to regulate a control gap. A second sleeve is mounted concentrically of the cylindrical surface and is movable relative to the button to control spray.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
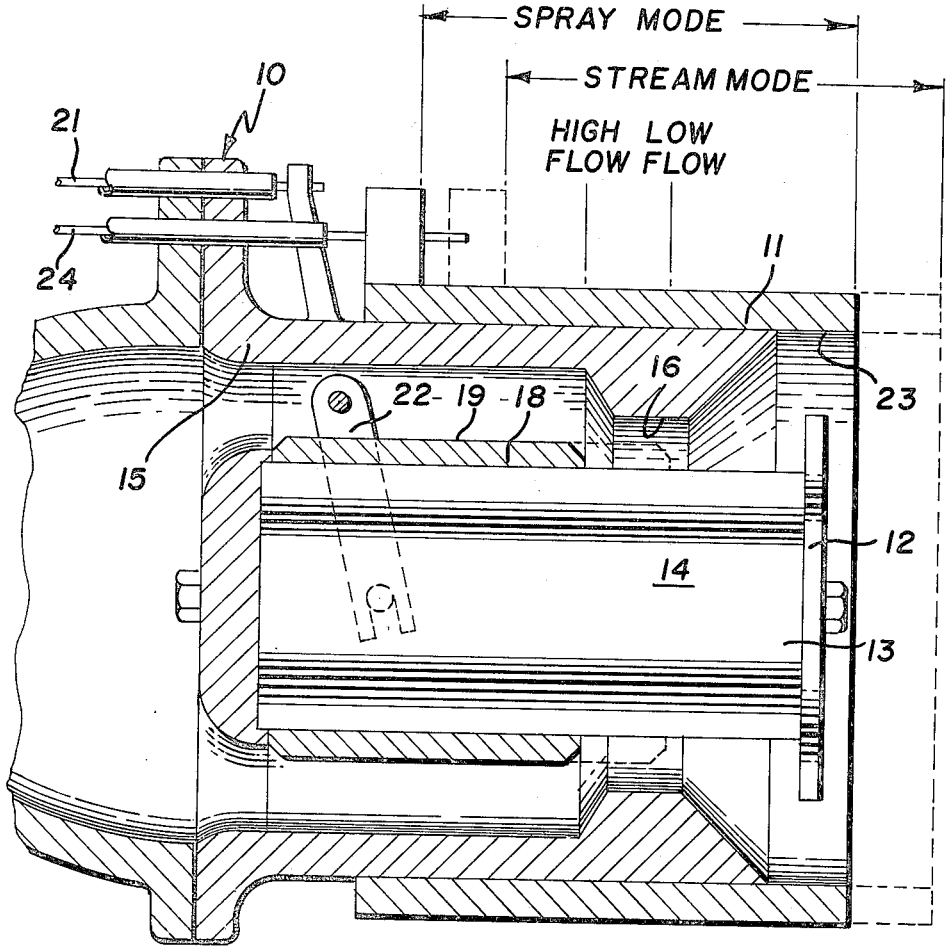
FIG. 1 is a vertical sectional view of the nozzle.
Figure 2:
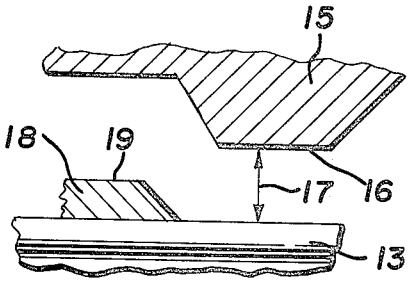
FIG. 2 is an enlarged view of parts of the nozzle in a high flow mode.

Referring first to FIG. 1, which best shows the general features of the invention, it can be seen that the nozzle, indicated generally by the reference numeral 10, is connected to a source of fluid under pressure.

Figure 3:
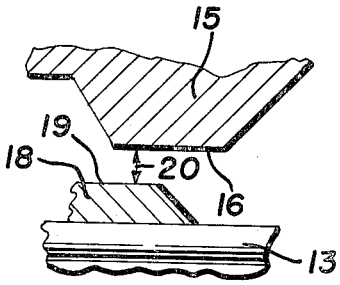
FIG. 3 is an enlarged view of parts of the nozzle in a low flow mode.

The nozzle 10 comprises a button 12 fixed to a stem 13 that has a cylindrical surface 14 and is located concentrically within a housing 15 in fixed relation thereto. Housing 15 has a forward, inwardly-protruding annular surface 16 that cooperates with surface 14 to form a high flow gap 17. An inner first sleeve 18 is slidably mounted on surface 14 and has a cylindrical outer surface 19 that cooperates with surface 16 when the sleeve 18 is in the forward position, as shown in FIG. 3, to form a low flow gap 20. Sleeve 18 is moved axially relative to stem 13 by means of a cable 21 acting through a pivoted lever 22. An outer second sleeve 11 is slidably mounted on the housing 15 and has a forwardly-extending inner cylindrical surface 23 for providing spray. The axial movement of sleeve 11 is provided by a push-pull cable 24.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Nozzle for non-aspirated fire-fighting medium, comprising:

(a) a fixed assembly including a housing and a button, said button being fixed to a stem which is fixedly and concentrically mounted within the housing, said stem having a cylindrical surface, the housing and the button being concentric with the cylindrical surface, (b) a first sleeve concentric with and slidable on the cylindrical surface and movable relative to the housing to regulate a control gap, and (c) a second sleeve concentric with the cylindrical surface, mounted externally on the housing, and movable relative to the button to control spray.

2. Nozzle as recited in claim 1, wherein the first sleeve is slidably mounted on the cylindrical surface and is movable axially, the control gap existing between the first sleeve and the housing and adjusted by the movement of the first sleeve.

3. Nozzle as recited in claim 1, wherein the control gap exists between a forward, inwardly-protruding annular surface on the housing and the first sleeve for low flow and between the annular surface and the cylindrical surface for high flow.

* * * * *